US006204439B1

(12) United States Patent
Chen

(10) Patent No.: US 6,204,439 B1
(45) Date of Patent: Mar. 20, 2001

(54) TRANSMISSION MECHANISM FOR MUSIC BOX ORNAMENT

(76) Inventor: Yu-Kai Chen, No. 2-2, Lane 15, Da Hsing St., Tan-Shui Town (TW)

( * ) Notice: Subject to any disclaimer, the term of this patent is extended or adjusted under 35 U.S.C. 154(b) by 0 days.

(21) Appl. No.: 09/489,435

(22) Filed: Jan. 21, 2000

(51) Int. Cl.[7] ..... G10F 1/06

(52) U.S. Cl. ..... 84/95.2; 84/95.1; 84/94.1; 84/94.2; 84/96; 84/97; 84/98; 446/366

(58) Field of Search ..... 84/94.1, 94.2, 84/95.1, 95.2, 96, 97, 98; 446/353, 366, 367

(56) References Cited

U.S. PATENT DOCUMENTS

| | | | | |
|---|---|---|---|---|
| 4,875,886 | * | 10/1989 | Sung | 446/298 |
| 5,473,969 | * | 12/1995 | Chen | 84/95.2 |
| 5,543,577 | * | 8/1996 | Zhu et al. | 84/95.2 |
| 5,571,979 | * | 11/1996 | Chen | 84/95.2 |

* cited by examiner

*Primary Examiner*—Shih-Yung Hsieh

(74) *Attorney, Agent, or Firm*—Madson & Metcalf

(57) ABSTRACT

A transmission mechanism for a music box having a plurality of ornaments coupled thereon includes a driving mechanism having a rotary wheel with an eccentric rod and disposed in the music box, a first support mounted in the music box and having a through hole, a connection rod having two opposite ends, a first elongated support member inserted through the through hole of the first support, secured on the first support and having one end coupled with an ornament and the other end secured on one end of the connection rod, a coupler having a first end connected with the other end of the connection rod and a second end coupled with the eccentric rod. Preferably, the transmission mechanism further includes a second support mounted in the music box and having a through hole, a following piece slidably moving along two opposite elongated sides of the second support, and a second elongated support member inserted through the through hole of the second support and having one end coupled with another ornament and the other end secured to the following piece. When the rotary wheel is rotated, the following piece is alternately moved up and down by the eccentric rod thereby resulting in a vertically reciprocated movement of one ornament, and the other end of the connection rod will be driven by the coupler thereby resulting in a reciprocated rotation of another ornament.

18 Claims, 8 Drawing Sheets

TRANSMISSION MECHANISM FOR MUSIC BOX ORNAMENT

FIELD OF THE INVENTION

The present invention relates to a transmission mechanism for a music box having a plurality of ornaments coupled thereon, and especially to an ornamental display assembly having vertically reciprocating and rotating decorative elements actuated by a common power source.

BACKGROUND OF THE INVENTION

Currently, various music box-incorporated ornamental display assemblies have been disclosed and have appeared on the market, such as carrousels or the like. These ornamental display assemblies are rotated or reciprocated by the driving mechanism of a wind-up music box mechanism through a transmission mechanism. However, conventional transmission mechanisms for use with wind-up music box mechanism are commonly complicated and expensive.

In addition, such kinds of devices are often provided with a plurality of decorative ornaments and may be provided with a mechanism to cause the decorative ornaments to move as the music drum rotates. The decorative elements are usually mounted on a support member which is associated with the drive mechanism to provide the movement to the decorative element.

In order to provide reciprocating movement and rotational movement to different decorative objects of the ornamental device, it is known to use an output shaft of the music drum to provide the power source for the reciprocating movement of a decorative element and to use the unwinding of spring to provide the rotational movement for a separative decorative element. When this concept is applied to a variety of movements of the decorative elements, separate drive mechanisms are required and the decorative elements must be laterally spaced apart on the ornamental display assembly. Such a placement inherently requires a complex drive system to provide the desired motion to the decorative elements.

Thus, it is desirable to improve the defects of the prior arts.

SUMMARY OF THE INVENTION

It is one object of the present invention to provide a transmission mechanism for a music box ornament which is simple in structure and inexpensive to manufacture.

It is another object of the present invention to provide an ornamental display assembly having vertically reciprocating and rotating decorative elements actuated by a common power source.

It is another yet object of the present invention to provide a transmission mechanism for music box ornament which moves different ornaments in different ways.

In the first preferred embodiment of the present invention, the transmission mechanism for a music box includes a support mounted in the music box and having a through hole, a following piece slidably moving along two opposite elongated sides of the support, an elongated support member inserted through the through hole of the support and having one end coupled with the ornament and the other end secured to the middle portion of the following piece (preferably by screwing or riveting), and a driving mechanism disposed in the music box and having a rotary wheel with an eccentric rod, wherein the following piece is alternately moved up and down by the eccentric rod thereby resulting in a vertically reciprocated movement of the ornament when the rotary wheel is rotated.

The support has two protrusions at the bottom thereof to be tightly engaged with two holes of a base of the music inbox. In addition, the support has an open upper end extended out from a top surface of the support and mounted around the through hole for preventing the elongated support member from shaking. Preferably, the open upper end is integrally formed with the support.

Preferably, the support has two elongated slots and the following piece has two lugs which extend from two opposite sides thereof and inserted into the two elongated slots for slidably moving along the two elongated slots.

In the second preferred embodiment of the present invention, the transmission mechanism for a music box includes a driving mechanism having a rotary wheel with an eccentric rod and disposed in the music box, a support mounted in the music box and having a through hole, a connection rod having two opposite ends, an elongated support member inserted through the through hole of the support, secured on the support, and having one end coupled with the ornament and the other end secured on one end of the connection rod, and a coupler having a first end connected with the other end of the connection rod and a second end coupled with the eccentric rod. The other end of the connection rod will be driven by the coupler when the rotary wheel is rotated, thereby resulting in a reciprocated rotation of the ornament.

Preferably, the eccentric rod has an annular groove formed thereon to prevent the second end of the coupler from separating from the eccentric rod.

More preferably, the eccentric rod has an annular collar portion formed thereon to prevent the second end of the coupler from separating from the eccentric rod.

In this embodiment, the support has an open upper end extended out from a top surface of the support and mounted around the through hole for preventing the elongated support member from shaking. Preferably, the open upper end is integrally formed with the support.

In addition, the transmission mechanism further includes a generally crosssectionally U-shaped resilient member to secure the elongated support member on the support by sleeving the U-shaped resilient member on an annular groove of the elongated support member to prevent the elongated support member from falling down or separating from the support after the elongated support member is inserted through the through hole of the support.

Preferably, the connection rod has two holes on two opposite ends thereof, in which the other end of the elongated support member is inserted into one hole of the connection rod and is fixed thereon by screwing, welding or riveting.

Preferably, the coupler is an S-loop structure which is connected with the connection rod by sleeving one end of the S-loop structure on a nut which is riveted on the other hole of the connection rod.

Preferably, the support has two protrusions at the bottom thereof to be tightly engaged with two holes of a base of the music inbox.

In the third preferred embodiment of the present invention, the transmission mechanism for a music box having a plurality of ornaments coupled thereon includes a driving mechanism having a rotary wheel with an eccentric rod and disposed in the music box, a first support mounted in the music box and having a through hole, a connection rod having two opposite ends, a first elongated support member inserted through the through hole of the first support, secured on the first support, and having one end coupled with one ornament and the other end secured on one end of the connection rod, a coupler having a first end connected with the other end of the connection rod and a second end coupled with the eccentric rod, a second support mounted in the music box and having a through hole, a following piece slidably moving along two opposite elongated sides of the second support, and a second elongated support member inserted through the through hole of the second support and having one end coupled with another ornament and the other end secured to the following piece. When the rotary wheel is rotated, the following piece is alternately moved up and down by the eccentric rod thereby resulting in a vertically reciprocated movement of the one ornament, and the other end of the connection rod will be driven by the coupler thereby resulting in a reciprocated rotation of another ornament.

The present invention may best be understood through the following description with reference to the accompanying drawings, in which:

DETAILED DESCRIPTION OF THE PREFERRED EMBODIMENT

The present invention will now be described more detailedly with reference to the following embodiments. It is to be noted that the following descriptions of the preferred embodiments of this invention are presented herein for the purpose of illustration and description only. It is not intended to be exhaustive or to be limited to the precise form disclosed.

Figure 1A:
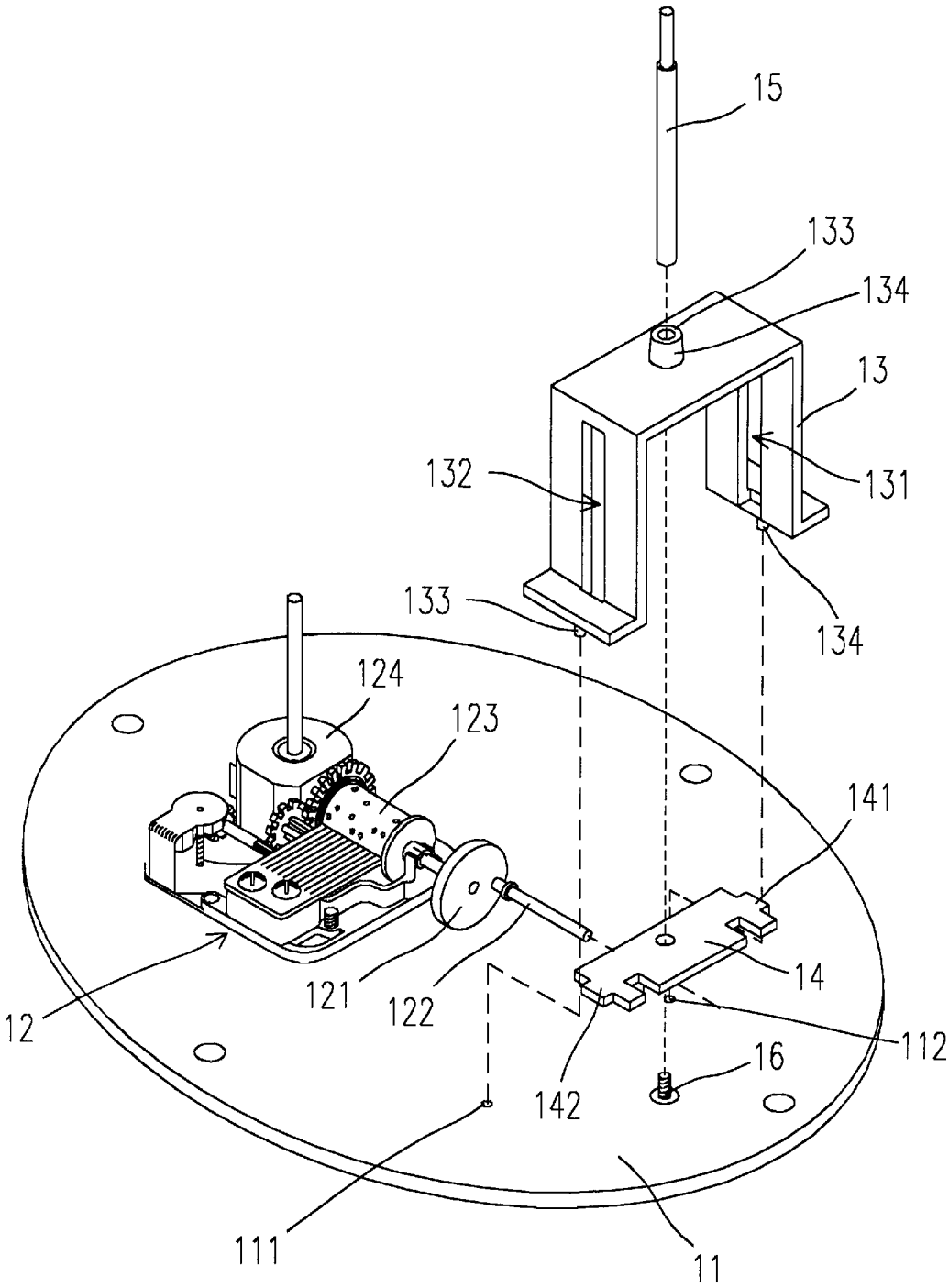
FIG. 1*a* is an exploded view of the first preferred embodiment of a transmission mechanism for a music box ornament according to the present invention.
Figure 1B:
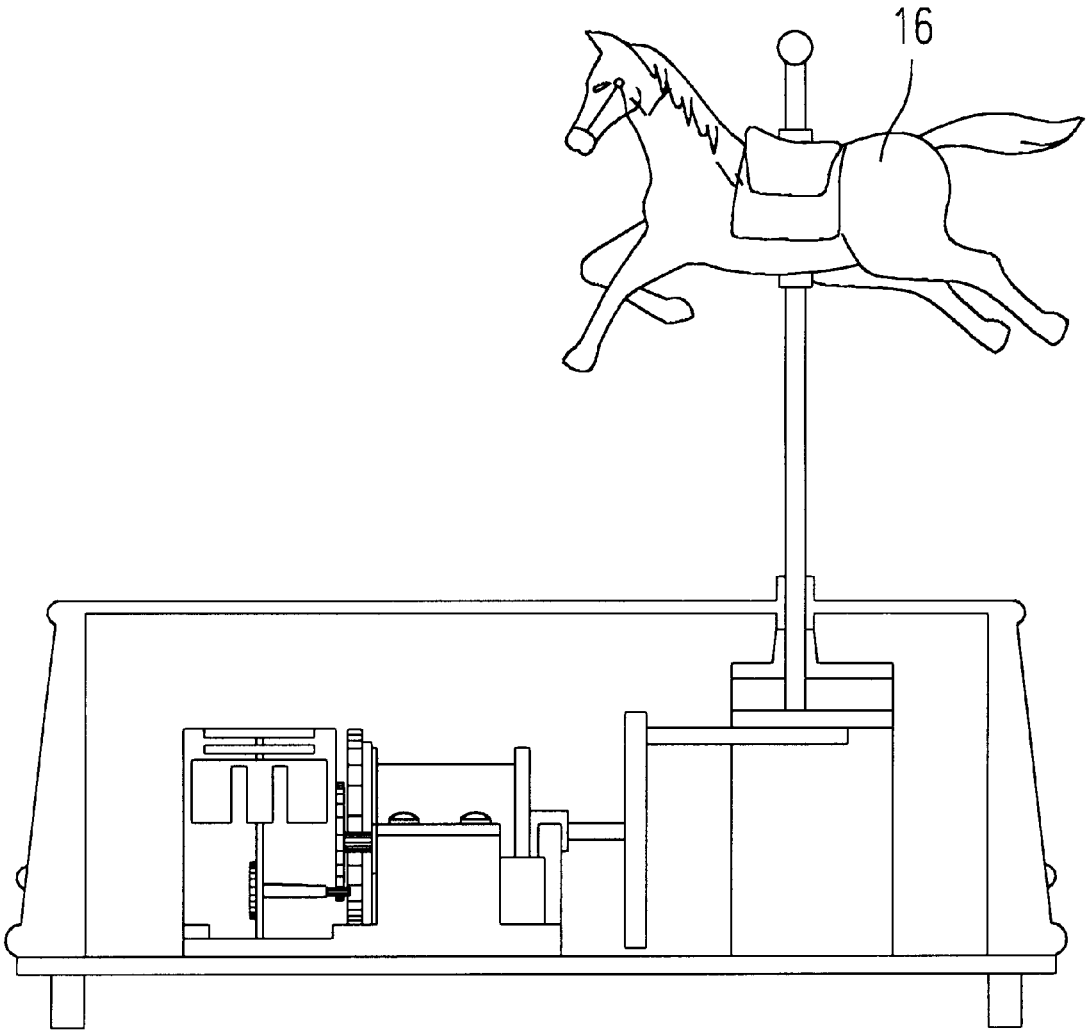
FIG. 1*b* is a sectional view of the transmission mechanism of FIG. 1*a*, which shows the up stroke of the ornament.
Figure 1C:
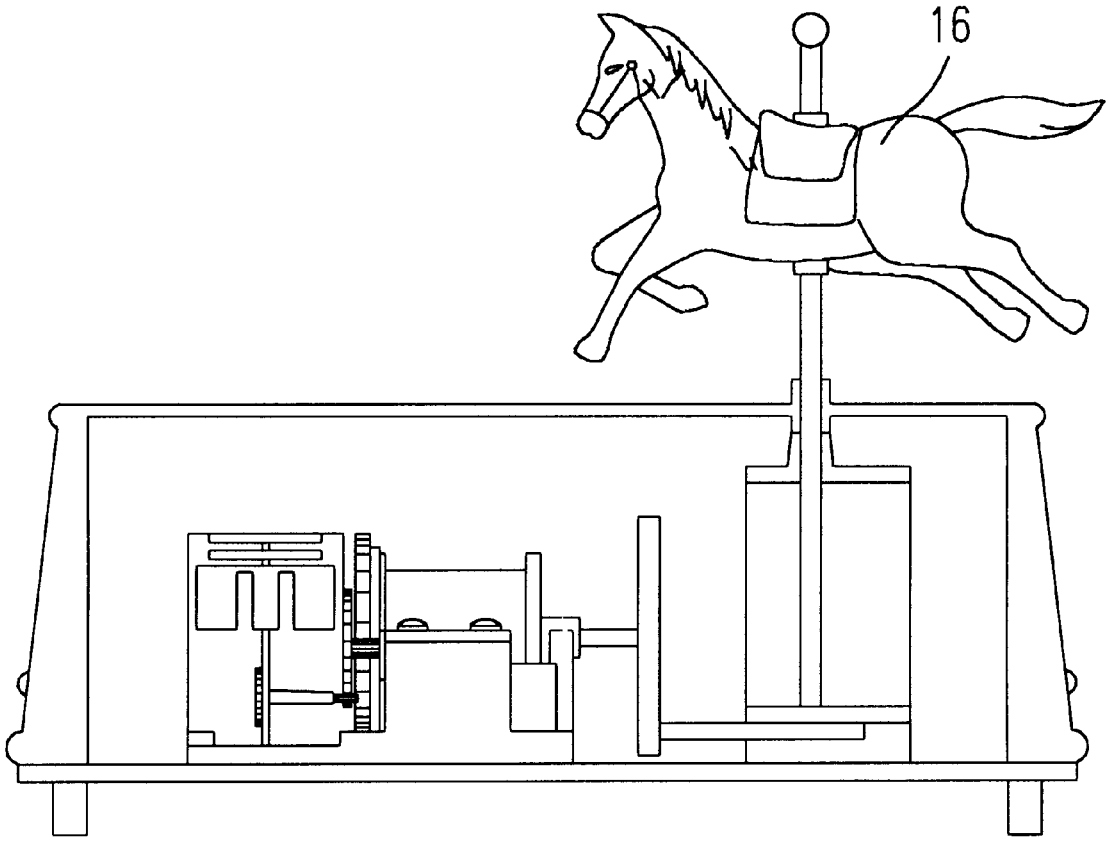
FIG. 1*c* is similar to FIG. 1*b* but shows the down stroke of the ornament.

Referring to FIGS. 1*a*~1*c* showing the first preferred embodiment of the present invention, the transmission mechanism for a music box includes a support 13, a following piece 14, an elongated support member 15, and a driving mechanism. The support 13 is secured on a base 11 of the music box by inserting two protrusions 133, 134 in two holes 111, 112 of the base 11. The following piece 14 has two lugs 141, 142 extending from two opposite sides thereof and respectively inserted into two elongated slots 131, 132 of the support for slidably moving along two elongated slots 131, 132. The elongated support member 15 is inserted through an open upper end 134 and a through hole 133 of the support. The open upper end 134 is extended out from a top surface of the support and mounted around the through hole for preventing the elongated support member 15 from shaking. Preferably, the open upper end 134 is integrally formed with the support 13. One end of the elongated support member 15 is coupled with an ornament and the other end of the elongated support member 15 is secured on the middle portion of the following piece 14 by screwing, welding, or riveting after the elongated support member 15 is inserted through the through hole 133.

As shown in FIGS. 1*a* and 1*b*, the ornament, referenced by 16, is driven by the driving mechanism 124 of the wind-up music box mechanism 12 of a music box. The wind-up music box mechanism 12 is a conventional device and disposed on the base 11 of the music box. The central shaft (not shown) of the reproducer 123 of the wind-up music box mechanism 12 has one end coupled to the driving mechanism 124, and an opposite end coupled to a rotary wheel 121. The rotary wheel 121 has an eccentric rod 122 at an outer side. When the rotary wheel 121 is rotated, the following piece 14 is alternately moved up and down by the eccentric rod 122, thereby resulting in a vertically reciprocated movement of the ornament.

Figure 1D:
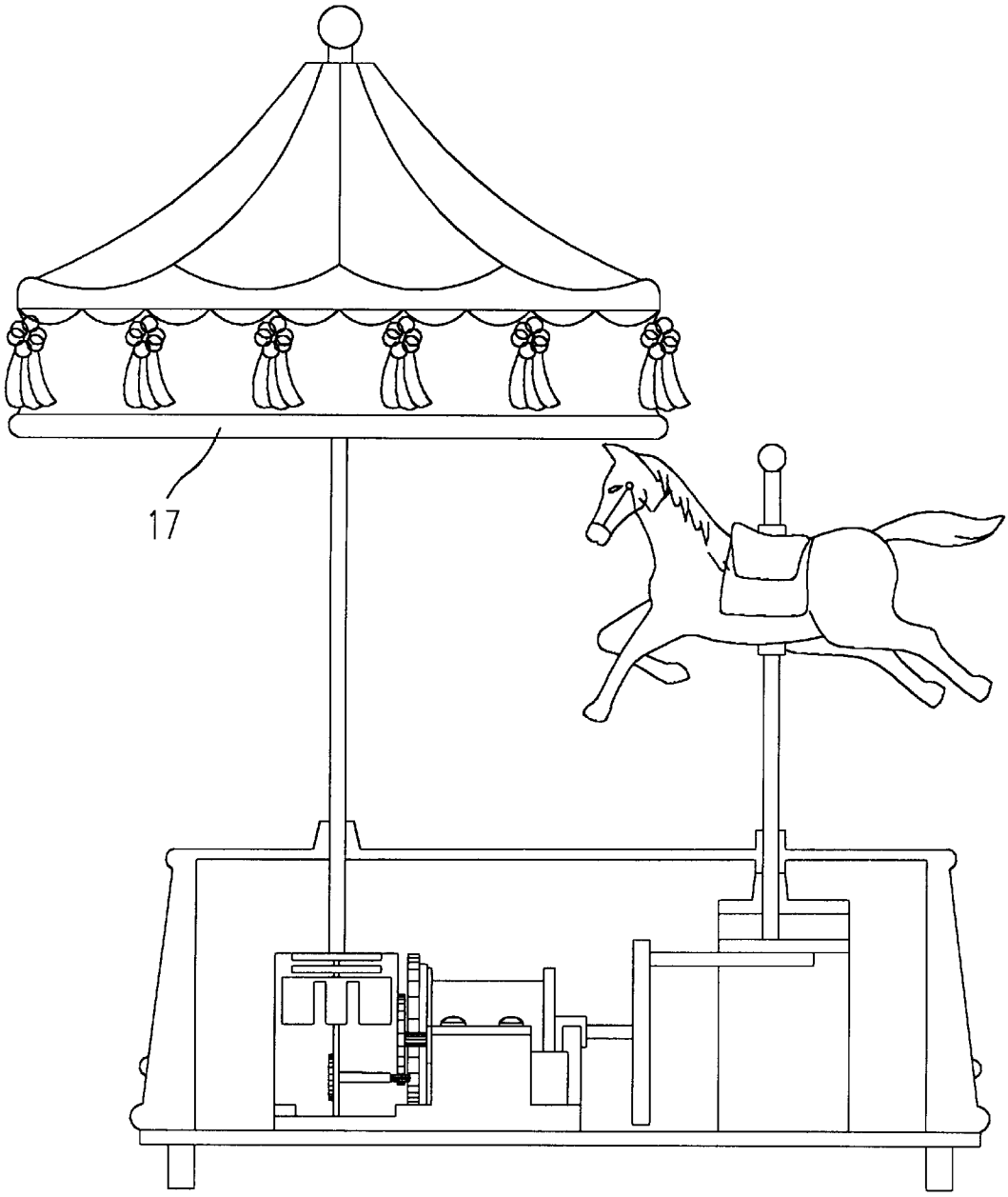
FIG. 1*d* shows a second ornament coupled to the revolving shaft of the driving mechanism shown in FIG. 1*b;*

FIGS. 1*b* and 1*c* show the up and down stroke of the ornament, respectively. Besides, referring to FIG. 1*d*, an upright rod is coupled to the revolving shaft of the driving mechanism 124 and driven by it to rotate an additional ornament 17.

Figure 2A:
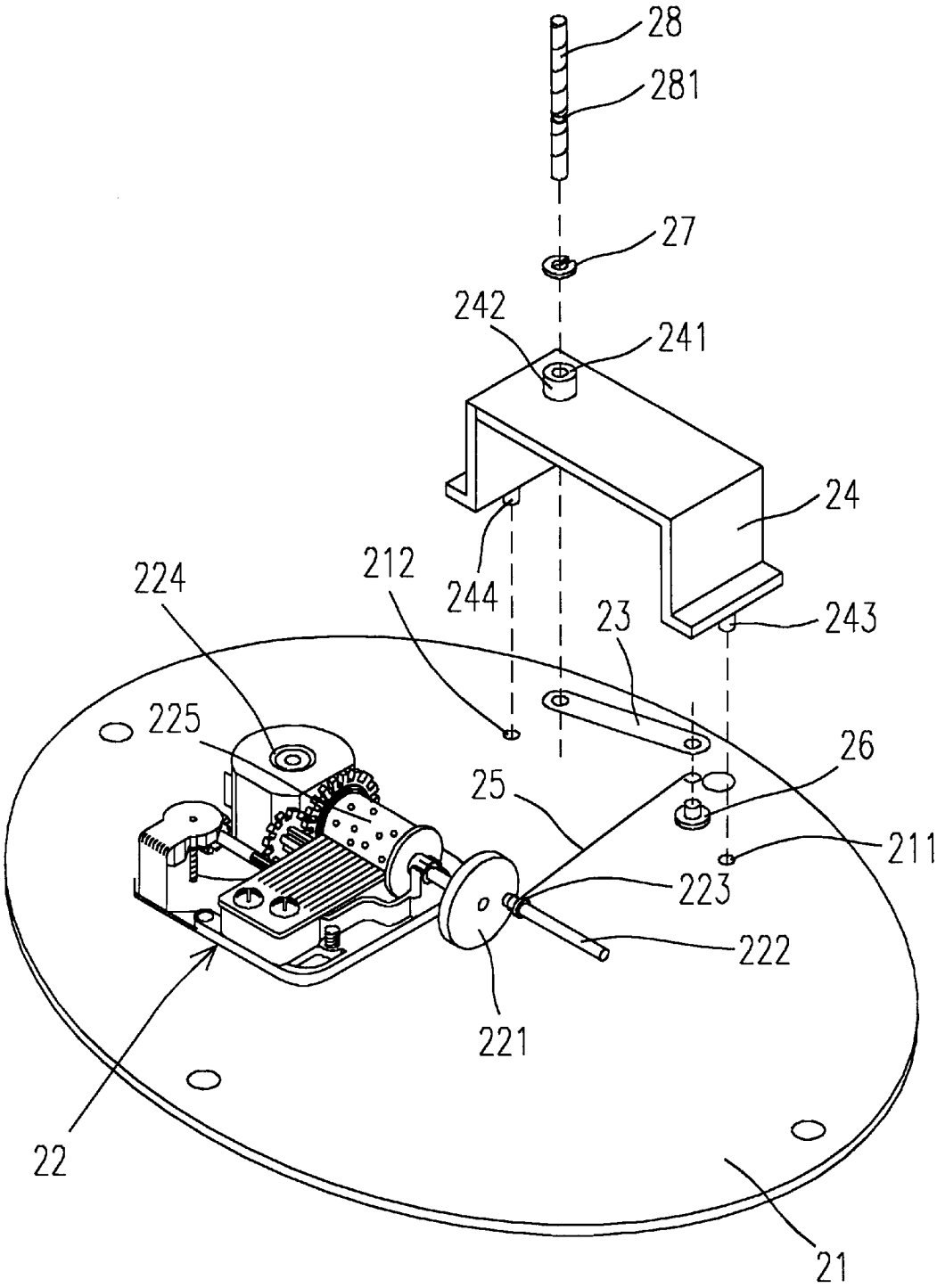
FIG. 2*a* is an exploded view of the second preferred embodiment of a transmission mechanism for a music box ornament according to the present invention.
Figure 2B:
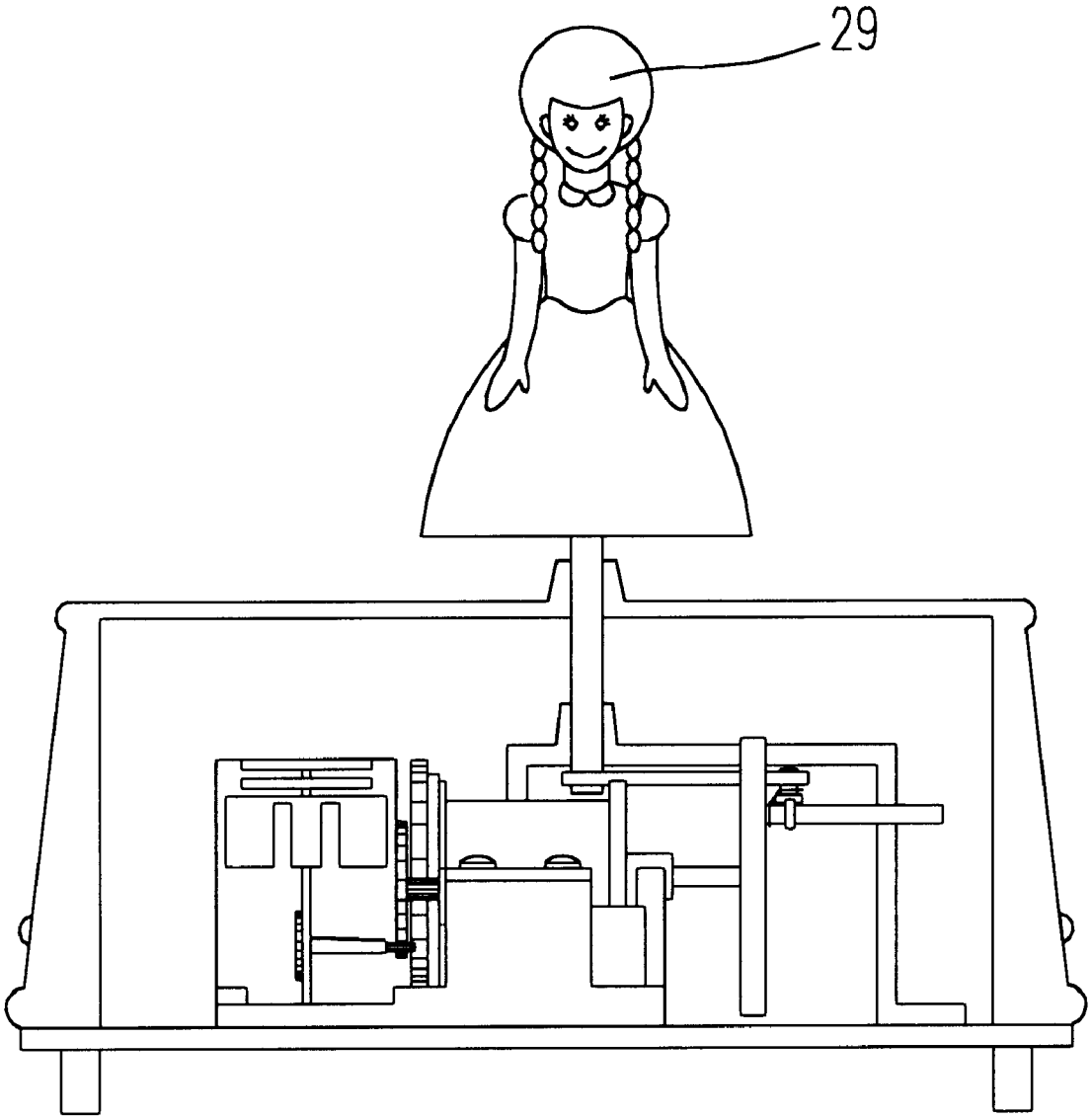
FIG. 2*b* is a sectional view of the transmission mechanism of FIG. 2*a*, which shows that the ornament is rotated to one direction.
Figure 2C:
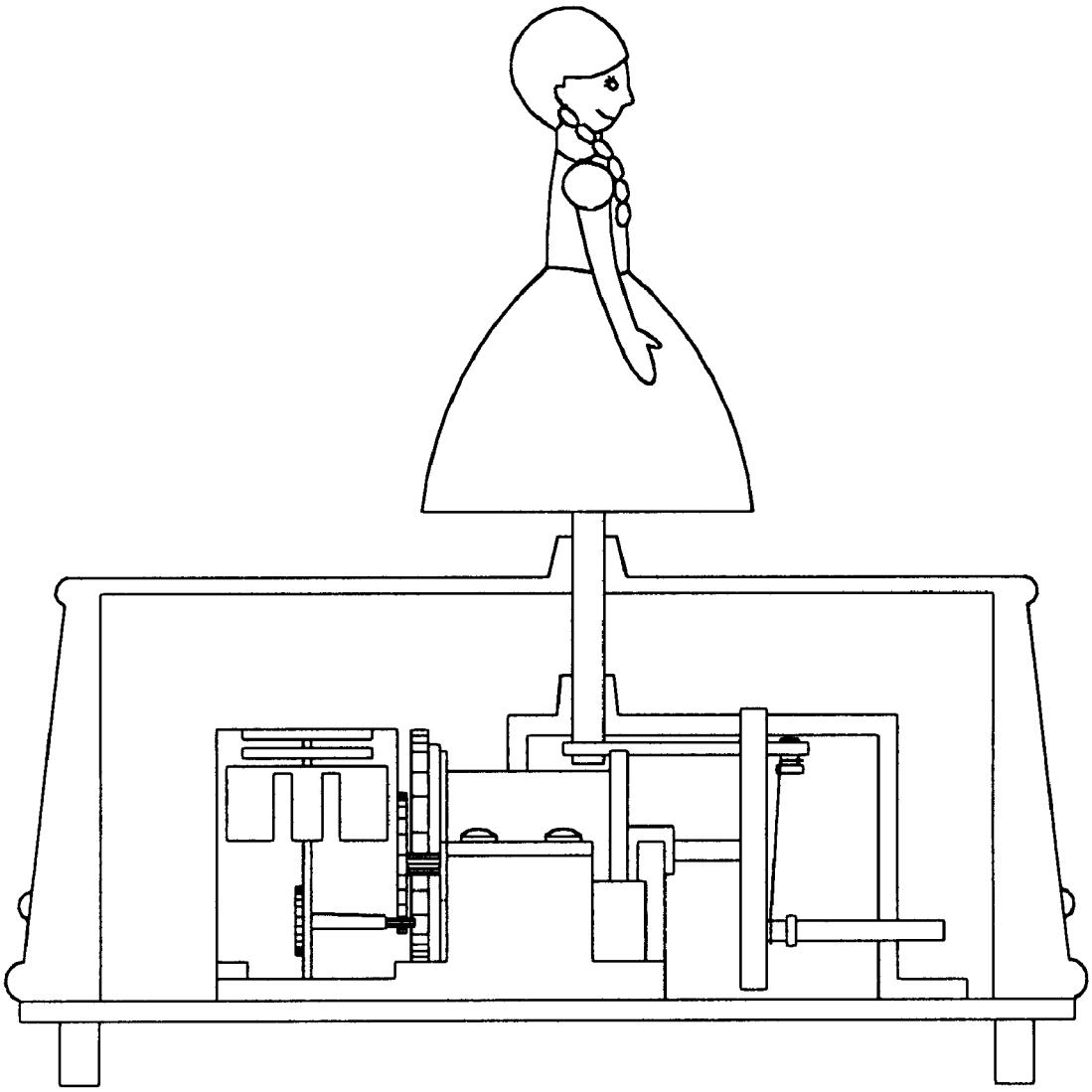
FIG. 2*c* is similar to FIG. 2*b* but shows that the ornament is rotated to another direction.

FIGS. 2*a*~2*c* show the second preferred embodiment of the present invention. As illustrated, the transmission mechanism for a music box includes a driving mechanism, a support 24, an elongated support member 28, a connection rod 23, and a coupler 25.

The support 24 is mounted on the base of the music box by inserting two protrusions 243, 244 in two holes 211, 212 of the base 21. The elongated support member 28 is inserted through an open upper end 242 and a through hole 241 of the support 24. The open upper end 242 mounted around the through hole 241 for preventing said elongated support member from shaking. Preferably, the support 24 is integrally formed with an open upper end 242. The top end of the elongated support member 28 is coupled with an ornament 29 (as shown in FIG. 2*b*) and the bottom end of the elongated support member 28 is secured on one end of the connection rod 23 by riveting or welding. A generally crosssectionally U-shaped resilient member 27 is secured on an annular groove 281 of the elongated support member 28 when the elongated support member 28 is inserted through the through hole 241 of the support in order to prevent the elongated support member from falling down or separating from the support.

The coupler 25 is preferably an S-loop structure, one end of which is connected with the other end of the connection rod 23 by sleeving one end of the S-loop structure on a nut which is riveted on the other hole of the connection rod 23, and the other end of which is coupled with the eccentric rod 222. Preferably, the eccentric rod 222 has an annular groove formed thereon to prevent the other end of S-loop from separating from the eccentric rod 222. Alternatively, the eccentric rod has an annular collar portion 223 formed thereon to prevent the other end of S-loop from separating from the eccentric rod 222 as shown in FIG. 2*a*.

The ornament, referenced by 29, is driven by the driving mechanism 224 of the wind-up music box mechanism 22 of a music box. The wind-up music box mechanism 22 is a conventional device and disposed on the base 21 of the music box. The central shaft (not shown) of the reproducer 225 of the wind-up music box mechanism 22 has one end coupled to the driving mechanism 224, and an opposite end coupled to a rotary wheel 221. The rotary wheel 221 has an eccentric rod 222 at an outer side.

When the rotary wheel is rotated, the other end of the connection rod will be driven by the S-loop structure thereby resulting in a reciprocated rotation of the ornament 29. FIGS. 2*b* and 2*c* respectively show that the ornament 29 is rotated to different directions. The rotation angle of the ornament 29 can range from 0° to 180°, depending on the length of the s-loop structure.

Figure 3:
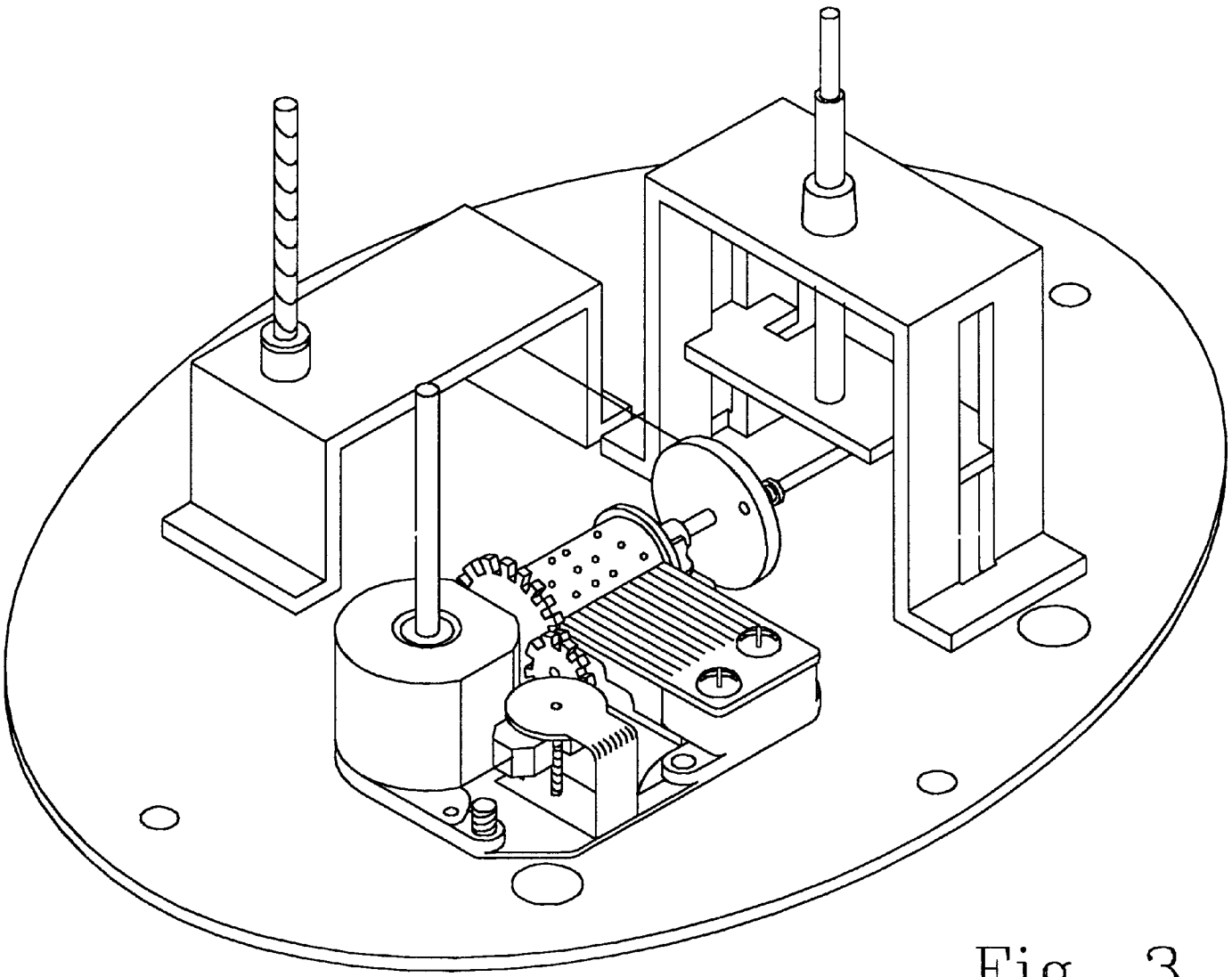
FIG. 3 is a perspective view of the third preferred embodiment of a transmission mechanism assembled with a music box according to the present invention.

Now, please refer to FIG. 3 which is a perspective view of the third preferred embodiment of the present invention. This embodiment is a combination of the first and second embodiments. When the rotary wheel is rotated, the following piece is alternately moved up and down by the eccentric rod thereby resulting in a vertically reciprocated movement of one ornament. Simultaneously, the connection rod carries on a simple harmonic motion thereby resulting in a reciprocated rotation of another ornament due to an S-loop connected between the eccentric rod and one end of the connection rod.

In conclusion, the present invention provides a transmission mechanism for a music box ornament which is simple in structure and inexpensive to manufacture. Furthermore, the assembled ornamental display has vertically reciprocating and rotating decorative elements actuated by a common power source, that is, different ornaments can move in different ways. In addition, all supports required by the present invention are directly secured on the base of the music box and thus they can prevent the ornaments from shaking when the ornaments are moving or rotating.

While the invention has been described in terms of what are presently considered to be the most practical and preferred embodiments, it is to be understood that the invention need not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A transmission mechanism for a music box having an ornament coupled thereon, comprising:

a support mounted in said music box and having a through hole;

a following piece slidably moving along two opposite elongated sides of said support;

an elongated support member inserted through said hole of said support and having one end coupled with said ornament and the other end secured to said following piece; and a driving mechanism disposed in said music box and having a rotary wheel with an eccentric rod, wherein said following piece is alternately moved up and down by said eccentric rod thereby resulting in a vertically reciprocated movement of said ornament when said rotary wheel is rotated wherein said support has two elongated slots and said following piece has two lugs which extend from two opposite sides thereof and are inserted into said two elongated slots for slidably moving along said two elongated slots.

2. The transmission mechanism of claim 1 wherein said support has two protrusions at the bottom thereof to be tightly engaged with two holes of a base of said music inbox.

3. The transmission mechanism of claim 1 wherein said support has an open upper end extended out from a top surface of said support and mounted around said through hole for preventing said elongated support member from shaking.

4. The transmission mechanism of claim 3 wherein said open upper end is integrally formed with said support.

5. The transmission mechanism of claim 1 wherein the other end of said elongated support member is secured to a middle portion of said following piece by one of screwing and riveting.

6. A transmission mechanism for a music box having an ornament coupled thereon, comprising:

a driving mechanism having a rotary wheel with an eccentric rod and disposed in said music box;

a support mounted in said music box and having a through hole;

a connection rod having two holes on two opposite ends thereof;

an elongated support member inserted through said through hole of said support, secured on said support, and having one end coupled with said ornament and the other end secured to one end of said connection rod, wherein the other end is inserted into one hole of said connection rod; and a coupler with an S-oop structure having a first end connected with the other end of said connection rod by sleeving one end of said S-loop structure on a nut which is riveted on the other hole of said connection rod, and a second end coupled with said eccentric rod, wherein the other end of said connection rod will be driven by said coupler when said rotary wheel is rotated, thereby resulting in a reciprocated rotation of said ornament.

7. The transmission mechanism of claim 6 wherein said eccentric rod has an annular groove formed thereon to prevent said second end of said coupler from separating from said eccentric rod.

8. The transmission mechanism of claim 6 wherein said eccentric rod has an annular collar portion formed thereon to prevent said second end of said coupler from separating from said eccentric rod.

9. The transmission mechanism of claim 6 wherein said support has an open upper end extended out from a top surface of said support and mounted around said through hole for preventing said elongated support member from shaking.

10. The transmission mechanism of claim 9 wherein said open upper end is integrally formed with said support.

11. The transmission mechanism of claim 6 further comprising a generally crosssectionally U-shaped resilient member to secure said elongated support member on said support by sleeving said U-shaped resilient member on an annular groove of said elongated support member after said elongated support member is inserted through said through hole of said support.

12. The transmission mechanism of claim 6, wherein said other end of said elongated support member is fixed onto said bole of said connection rod by one way selected from a group consisting of screwing, welding, and riveting.

13. The transmission mechanism of claim 12 wherein the rotation angle of said ornament ranges from 0° to 180° depending on the length of said s-loop structure.

14. The transmission mechanism of claim 6 wherein said support has two protrusions at the bottom thereof to be tightly engaged with two holes of a base of said music inbox.

15. A transmission mechanism for a music box having a plurality of ornaments coupled thereon, comprising:

a driving mechanism having a rotary wheel with an eccentric rod and disposed in said music box;

a first support mounted in said music box and having a through hole;

a connection rod having two opposite ends;

a first elongated support member inserted through said through hole of said first support, secured on said first support, and having one end coupled with one ornament and the other end secured on one end of said connection rod;

a coupler having a first end connected with the other end of said connection rod and a second end coupled with said eccentric rod, a second support mounted in said music box and having a through hole;

a following piece slidably moving along two opposite elongated sides of said second support; and a second elongated support member inserted through said through hole of said second support and having one end coupled with another ornament and the other end secured to said following piece;

when said rotary wheel is rotated, said following piece is alternately moved up and down by said eccentric rod thereby resulting in a vertically reciprocated movement of said one ornament, and the other end of said connection rod will be driven by said coupler thereby resulting in a reciprocated rotation of said another ornament.

16. The transmission mechanism of claim 15 wherein said eccentric rod has an annular groove formed thereon to prevent said second end of said coupler from separating from said eccentric rod.

17. The transmission mechanism of claim 15 wherein said eccentric rod has an annular collar portion formed thereon to prevent said second end of said coupler from separating from said eccentric rod.

18. The transmission mechanism of claim 15 wherein said coupler is an S-loop structure which is connected with said connection rod by sleeving one end of said S-loop structure on a nut which is riveted on the other hole of said connection rod.

* * * * *